US006494409B1

(12) United States Patent
Franke

(10) Patent No.: US 6,494,409 B1
(45) Date of Patent: Dec. 17, 2002

(54) RAILWAY CODE FOLLOWING APPARATUS

(75) Inventor: Raymond C. Franke, Glenshaw, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 10/068,719

(22) Filed: Feb. 6, 2002

(51) Int. Cl.[7] ..... B61L 21/00
(52) U.S. Cl. ..... 246/34 R; 246/34 B; 324/207.2
(58) Field of Search ..... 246/1 C, 34 R, 246/34 A, 34 B, 34 CT, 41, 58, 28 F, 122 R; 324/76.39, 76.75, 117 H, 251, 207.2; 701/19

(56) References Cited

U.S. PATENT DOCUMENTS

| | | | | |
|---|---|---|---|---|
| 3,661,089 A | | 5/1972 | Stolz | |
| 4,320,880 A | | 3/1982 | Sibley | |
| 4,415,134 A | | 11/1983 | Wilson | |
| 4,451,018 A | | 5/1984 | Smith et al. | |
| 4,498,650 A | | 2/1985 | Smith et al. | |
| 4,737,710 A | | 4/1988 | Van Antwerp et al. | |
| 4,901,008 A | * | 2/1990 | Quastel et al. | 324/117 H |
| 4,935,698 A | | 6/1990 | Kawaji et al. | |
| 5,263,670 A | * | 11/1993 | Colbaugh et al. | 246/167 R |
| 5,694,038 A | | 12/1997 | Moody et al. | |
| 5,922,034 A | * | 7/1999 | Feely | 701/19 |
| 6,232,768 B1 | | 5/2001 | Moody et al. | |

OTHER PUBLICATIONS

Coilcraft, "50/60 Hz Current Sensors—CS60 Series", Document 134, Sep. 19, 200, 1 page.

www.ec2.com/products/inductors&transformers/toroidalinductors/vhedcs/vhedcs.htm, "Vertical Standing Hall Effect Digital Current Sensors", Dec. 20, 2001, 4 pp.

EC2 Engineered Components Company, "Vertical Standing, Hall Effect Digital Current Sensors", Catalog No. C.051898R, 2 pp. (no date).

Delphi Technologies, Inc., "Technology Group: Electronic—Sensors, Magneto–Resistive (MR) Sensors", 2001, 1 page.

* cited by examiner

*Primary Examiner*—Mark T. Le
(74) *Attorney, Agent, or Firm*—Kirk D. Houser; Eckert Seamans Cherin & Mellott, LLC

(57) ABSTRACT

A solid state code following track relay receives pulsating rail current from a railway code transmitter. The track relay includes first and second inputs structured to receive the rail current. Two Hall effect digital current sensors each have a coil and an output, which responds to current flowing through the coil. The coils of the current sensors are electrically connected in series between the first and second inputs and are structured to receive the rail current. The outputs of the current sensors are structured to turn on and off in response to the rail current. A circuit including dual one-shot multivibrators, which are triggered by positive and negative going edges from the respective current sensors, and a flip-flop, which is set and reset by the outputs of the respective multivibrators, determines that each of the current sensors is functional. Two solid state outputs are structured to follow the rail current.

21 Claims, 5 Drawing Sheets

RAILWAY CODE FOLLOWING APPARATUS

BACKGROUND OF THE INVENTION

1. Field of the Invention

The present invention deals with railway control and, more particularly, to code following apparatus, such as code following track relays, for receiving pulsating rail current from a railway code transmitter.

2. Background Information

A conventional railroad track circuit typically includes a battery, a resistor, a track, and a relay. The feed or battery end and the relay end of the track circuit are electrically connected to the two rails of the track. Under conditions when a vehicle, such as a train, is not within the track circuit, the battery energizes the coil of the relay through the series combination of the-resistor, the first rail, the coil and the second rail. In turn, the normally open contact of the energized relay closes. The track circuit employs the shunting properties of the train's wheels and axle (i.e., a train shunt) to sufficiently reduce the current in the relay coil and, thus, open the normally open contact, in order to indicate the presence of the train in the track circuit.

As shown in FIG. 1, a conventional code following railway track relay (TR) 2 is used in a railway track circuit 3 in which a low voltage battery source 4, at one end 6 of the circuit, is interrupted at a low frequency (e.g., generally less than about 3 Hz) by a conventional railway code transmitter 8. At the other end 10 of the track circuit 3, the code following track relay 2 responds to the pulsating current on the rails 12,14, thereby opening and closing its contacts 16. The series combination of a resistor 18, the low voltage battery source 4 and the railway code transmitter 8 are electrically connected to the rails 12,14 at the one circuit end 6. The series combination of a resistor 20 and the coil 22 of the track relay 2 are electrically connected to the rails 12,14 at the other circuit end 10.

Typically, the coil resistance of code following relays, such as TR 2, is typically in the order of about 0.5 Ω, with operating current being in the order of 0.5 A. Again, because code following relays are electro-mechanical devices and operate constantly, they are subject to wear. Particularly, the contacts, such as 16, pit and erode from constant electrical switching. For safety reasons, it is important for the relay operating current to remain relatively stable. If it were possible for the operating current to reduce significantly, then a broken rail could go undetected and, thus, jeopardize train safety. Periodic re-calibration to ensure consistency of the operating current is the process by which safety is assured.

As employed in railway signaling, the dynamic action of the code following relay indicates that the particular track circuit is not occupied. If the relay is not responding to the dynamic action of the rail current, then the particular track section is occupied. Hence, restrictive signals are displayed in order that a train has sufficient distance to stop.

In such railroad code following relays, the term "BACK" corresponds to relay contacts that are closed when the relay is de-energized. Similarly, the term "FRONT" corresponds to relay contacts that are closed when the relay is energized.

In general, electro-mechanical relays wear out after long periods of constant cycling. In particular, code following railway track relays suffer the same problem.

There is a need, therefore, for a circuit that improves the reliability of code following railway track relays after long periods of constant cycling.

U.S. Pat. No. 3,661,089 discloses a code reader for an automated vehicle, which moves along a path having a plurality of magnetic code elements located at sensing stages along the path. The code reader includes a plurality of Hall-effect devices. For each of the Hall-effect devices, a pulse driving circuit couples an actuating pulse of current through the device terminals responsive to a common pulse generator. A difference amplifier is coupled across the output electrodes of each of the Hall-effect devices. The difference amplifier produces a positive or negative potential output signal based upon the magnetic orientation of the magnetic code elements. Bipolar outputs provide a logic level "1" for respective positive and negative potential output signals, again based upon the magnetic orientation of the magnetic code elements. A downstream control system preferably includes error-detecting circuitry to detect the occurrence of two simultaneous logic level "1" output signals from the same sensing state.

U.S. Pat. No. 4,415,134 discloses a Hall effect track circuit-receiving element. Wires are connected to two track rails and are series-connected with a Hall effect cell through a switch. The Hall effect cell includes a coil forming a part of an electromagnetic device, which is located within the cell. A receiver receives its input from the Hall effect cell along output lines.

U.S. Pat. Nos. 4,498,650; and 4,451,018 disclose a toroid including a first conductor forming a winding, which is coupled to track rails via a switch. The MMF of one of two polarities is induced in the toroid depending on whether one of two check winding conductors is energized. An air gap in the core of the toroid has a Hall sensor located therein to respond to the MMF induced in the core as a result of current flowing in any of the conductors. In turn, the Hall sensor provides an output voltage.

U.S. Pat. No. 4,320,880 discloses an electronic track current switching relay system, which emulates the operation of a polar relay for applying coded pulses to railway tracks. A timer circuit includes a high-limit threshold circuit and a low-limit threshold circuit, which trigger a flip-flop or latch.

U.S. Pat. No. 4,935,698 discloses a dual-Hall integrated circuit (IC) including two essentially identical Hall elements, which are connected in series. In the IC, the outputs of the two Hall elements are differentially connected to the input of a differential amplifier, in order that the output voltage is a function of the difference between the magnetic fields at the Hall elements. The output of the amplifier is connected to the input of a Schmidt trigger circuit having an output connected to the IC output terminal. The IC and a magnet form a proximity sensor.

U.S. Pat. No. 4,737,710 discloses a Hall-effect position sensor apparatus, which senses the position of a moving body and provides an output signal indicative of the position of the moving body. The apparatus includes a predetermined number of Hall-effect sensors, which are positioned in a straight line and in operating proximity to a moving body made of a ferromagnetic material.

U.S. Pat. Nos. 5,694,038; and 6,232,768 disclose a Hall element having an output connected to the input of a Hall voltage amplifier. The Hall element may be mounted at a pole of a magnet, in order that when a ferrous article approaches, the Hall voltage and, thus, the amplified Hall voltage increase (or decrease depending on the polarity of the magnet pole).

SUMMARY OF THE INVENTION

The present invention employs a Hall effect digital current sensor, which has a Hall sensor in the gap of a toroid, in order to turn on and off in response to pulsating rail current. This provides electrical isolation of rail current to downstream solid state switching devices that function like the mechanical contacts of an electro-mechanical relay.

As one aspect of the invention, a code following apparatus for receiving pulsating rail current from a railway code transmitter comprises: first and second inputs structured to receive the pulsating rail current; two Hall effect digital current sensors, each of the Hall effect digital current sensors having a coil and an output, which responds to current flowing through the coil, the coils of the Hall effect digital current sensors being electrically connected in series between the first and second inputs and being structured to receive the pulsating rail current, the outputs of the Hall effect digital current sensors being structured to turn on and off in response to the pulsating rail current; means for determining that each of the Hall effect digital current sensors is functional; and at least one output structured to follow the pulsating rail current.

The output of the Hall effect digital current sensors may have a signal with a plurality of positive going edges and a plurality of negative going edges in response to the pulsating rail current. The means for determining may comprise first and second one-shot multivibrators, the one-shot multivibrators having an input, which is connected to a corresponding one of the outputs of the first and second Hall effect digital current sensors, the one-shot multivibrators further having an output, the output of the first one-shot multivibrator responding to the positive going edges of the first Hall effect digital current sensor, and the output of the second one-shot multivibrator responding to the negative going edges of the second Hall effect digital current sensor.

The means for determining may further comprise a flip-flop including a set input, a reset input and an output. The output of the first one-shot multivibrator may be electrically interconnected with the reset input of the flip-flop, and the output of the second one-shot multivibrator may be electrically interconnected with the set input of the flip-flop.

The output of the flip-flop may have an alternating signal with a set state and a reset state, the alternating signal indicating that the first and second Hall effect digital current sensors are functional.

The output of the flip-flop may have a static signal with one of a set state and a reset state, the static signal indicating that at least one of the first and second Hall effect digital current sensors is not functional.

As another aspect of the invention, a solid state code following track relay for receiving pulsating rail current from a railway code transmitter comprises: first and second inputs structured to receive the pulsating rail current; two Hall effect digital current sensors, each of the Hall effect digital current sensors having a coil and an output, which responds to current flowing through the coil, the coils of the Hall effect digital current sensors being electrically connected in series between the first and second inputs and being structured to receive the pulsating rail current, the outputs of the Hall effect digital current sensors being structured to turn on and off in response to the pulsating rail current; means for determining that each of the Hall effect digital current sensors is functional; and at least one solid state output structured to follow the pulsating rail current.

The output of the Hall effect digital current sensors may have a signal with a plurality of positive going edges and a plurality of negative going edges in response to the pulsating rail current. The means for determining may comprise first and second one-shot multivibrators, the one-shot multivibrators having an input, which is connected to a corresponding one of the outputs of the first and second Hall effect digital current sensors, the one-shot multivibrators further having an output, the output of the first one-shot multivibrator responding to the positive going edges of the first Hall effect digital current sensor, and the output of the second one-shot multivibrator responding to the negative going edges of the second Hall effect digital current sensor. The means for determining may further comprise a flip-flop including a set input, a reset input and an output. The output of the first one-shot multivibrator may be electrically interconnected with the reset input of the flip-flop, and the output of the second one-shot multivibrator may be electrically interconnected with the set input of the flip-flop.

The first and second output circuits may comprise means for outputting a first signal and means for outputting a second signal, which is a substantially inverted version of the first signal, respectively. The first and second output circuits may further comprise first and second FETs, respectively. The means for outputting a first signal and the means for outputting a second signal may include means for ensuring that at least one of the first and second FETs is turned off.

As a further aspect of the invention, a code following apparatus for a pulsating rail current from a railway code transmitter comprises: a first terminal structured to input the pulsating rail current; a second terminal structured to output the pulsating rail current; first means for responding to the pulsating rail current flowing from the first terminal and for outputting a corresponding first signal, which turns on and off in response to the pulsating rail current; second means for responding to the pulsating rail current flowing from the first means and toward the second terminal and for outputting a corresponding second signal, which turns on and off in response to the pulsating rail current; means for determining that each of the first and second means is functional based upon the first and second signals and for outputting a third signal, which follows the pulsating rail current; and at least one output structured to follow the third signal.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
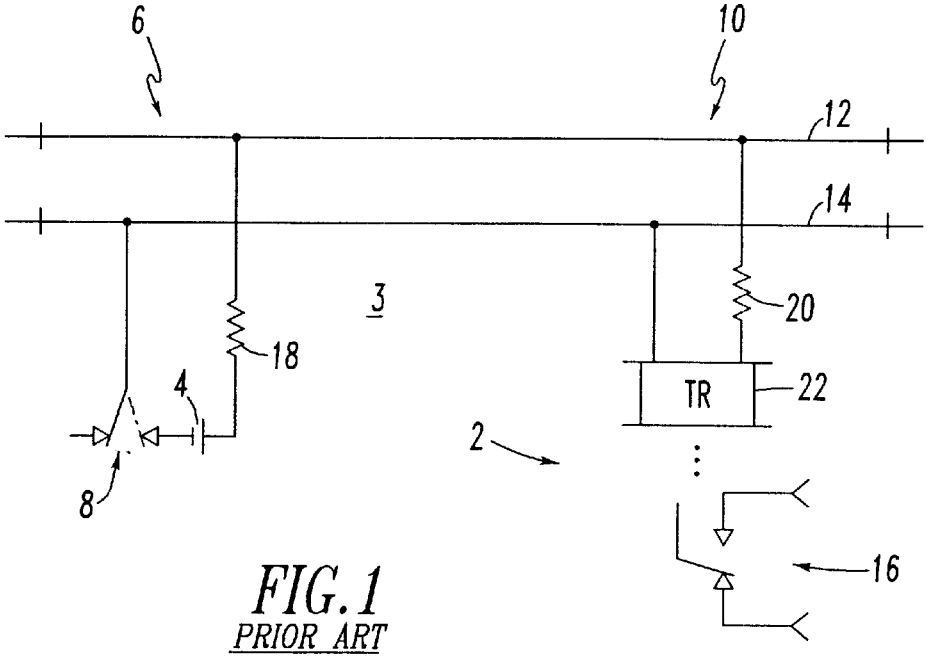
FIG. 1 PRIOR ART
FIG. 1 is a block diagram in schematic form of a conventional code transmitter and a conventional code following track relay.
Figure 2:
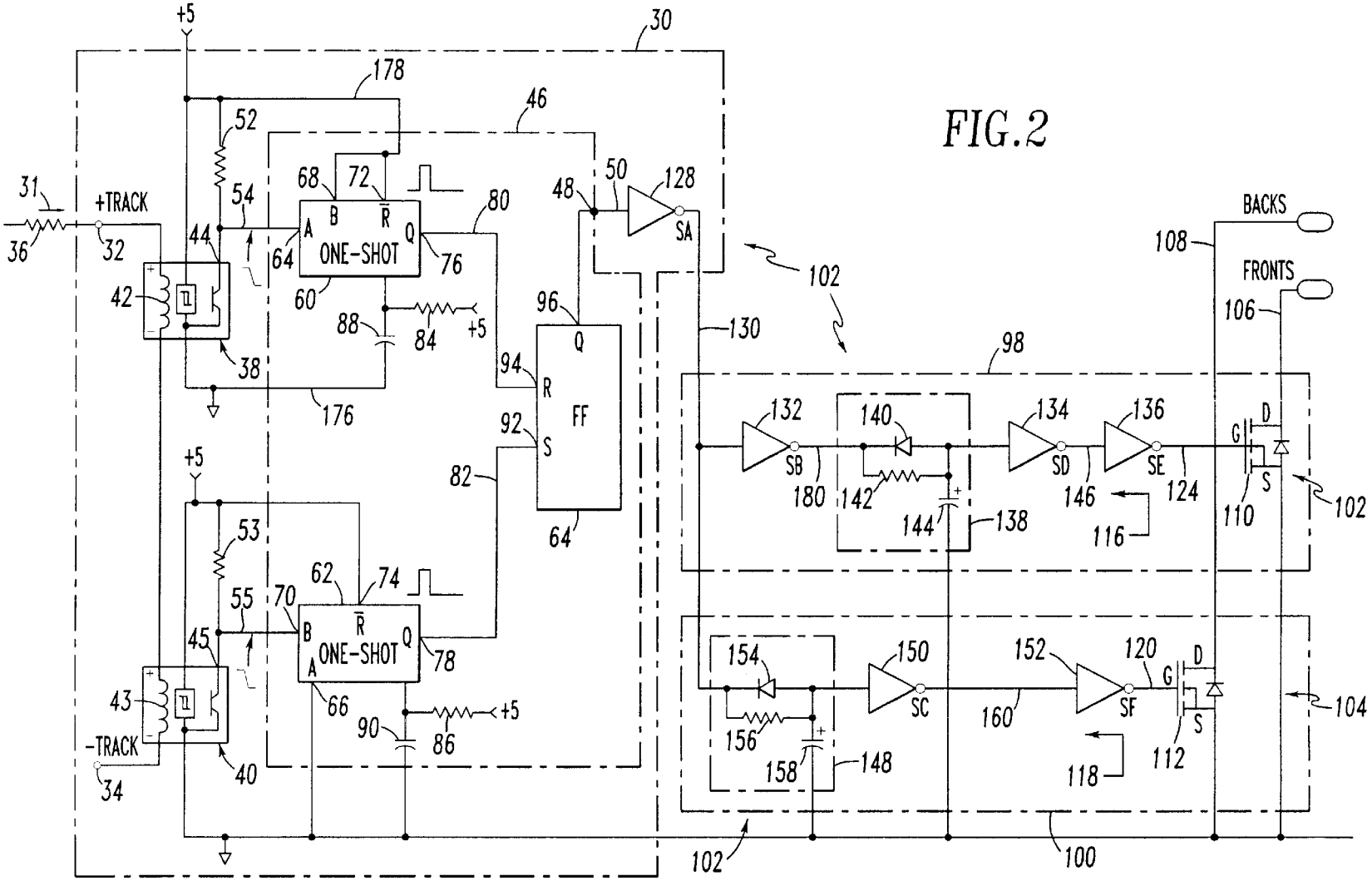
FIG. 2 is a block diagram in schematic form of a solid state railway code following track relay including two Hall effect digital current sensors in accordance with the present invention.
Figure 4:
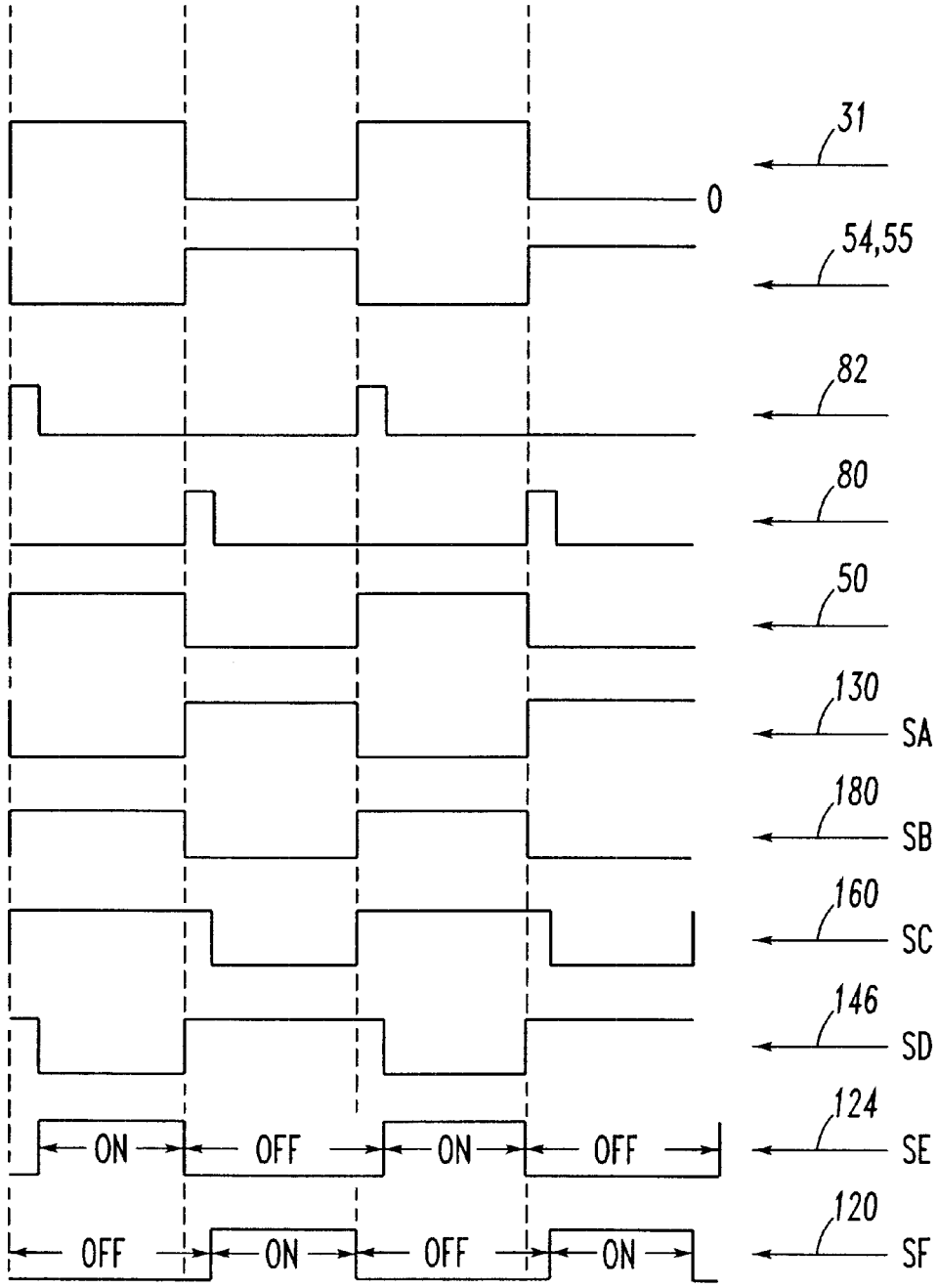
FIG. 4 is a timing diagram for various signals of the block diagram of FIG. 2.

Referring to FIG. 2, a code following apparatus 30 in accordance with the present invention receives pulsating rail current 31 (as best shown in FIG. 4) at inputs, such as suitable input terminals 32,34, from a railway code transmitter (e.g., such as transmitter 8 of FIG. 1). The first and second input terminals 32,34 are structured to receive the pulsating rail current 31 through a resistor, such as 36, which may be part of or external to the apparatus 30. The resistor 36 is electrically connected to the first input terminal 32 and is in series with the coils 42,43 of the respective Hall effect digital current sensors 38,40. These coils 42,43 are electrically connected in series between the first and second input terminals 32,34 and are structured to receive the pulsating rail current 31 flowing through the resistor 36.

The two Hall effect digital current sensors 38,40 also have outputs 44,45, which respond to the common pulsating rail current 31 flowing through the coils 42,43. These outputs 44,45 are structured to turn ON and OFF in response to the pulsating rail current 31. In accordance with the invention, the Hall effect digital current sensors 38,40 are employed in combination with a circuit 46 for determining that each of such sensors is functional, by providing one or more outputs, such as output 48, having a dynamic signal 50, which follows the pulsating rail current 31 as shown in FIG. 4.

In the exemplary embodiment the sensors 38,40 are model VHEDCS-0.5 Hall Effect Digital Current Sensors made by $EC^2$ Engineered Components Company of San Luis Obispo, Calif., although any suitable current level sensitivity and/or any suitable analog or digital Hall effect current sensor may be employed. Although Hall effect digital current sensors 38,40 are disclosed, analog Hall sensors may be employed, albeit with additional circuitry (not shown), in order to provide suitable digital outputs, such as 44,45. Preferably, the sensors 38,40 are suitably matched, in order that their respective outputs 44,45 turn ON and OFF at about the same current level. As a further alternative to analog Hall sensors, a suitable magneto-resistive device may be employed.

The exemplary sensor outputs 44,45 are "open-collector" and are pulled-up through resistors 52,53, respectively. The coils 42,43 and the outputs 44,45 of each of the Hall effect digital current sensors 38,40, respectively, are electrically isolated. The sensor output signals 54,55 have a first state (e.g., on or low) when the pulsating rail current 31 is greater than a first or "operate current" level and a second state (e.g., off or high) when the pulsating rail current is less than a second or "release current" level. When sensing zero current, the voltage of the sensor output signals 54,55 is high (e.g., about equal to the supply voltage 178). The sensor output voltage remains high as long as the sensed current level is less than the "operate current" level. When the sensed current level is increased to above the "operate current" level, then the output voltage goes to a low level (e.g., about 0.2 VDC in the exemplary embodiment). The output voltage remains at the low level until the sensed current is decreased to below the "release current" level. When the sensed current level is decreased to below release current level, then the output voltage goes high through the corresponding one of the pull-up resistors 52,53. In response to the pulsating rail current 31, as shown in FIG. 4, the sensor output signals 54,55 have a plurality of positive going edges and a plurality of negative going edges. Hence, the Hall effect digital current sensors 38,40 can sense either DC or AC current.

Since the sensors 38,40 are preferably matched, the "operate current" level of the first Hall effect digital current sensor 38 is substantially identical (e.g., 0.5 A±10% in the exemplary embodiment) to the "operate current" level of the second Hall effect digital current sensor 40, and the "release current" level of the first sensor 38 is substantially identical to the "release current" level of the second sensor 40, in order that both sensor outputs 44,45 turn ON and OFF substantially contemporaneously at suitably close to the same current level.

The circuit 46 includes first and second one-shot multivibrators 60,62 and a set/reset flip-flop (FF) 64. The multivibrators 60,62 include first inputs (A) 64,66, second inputs (B) 68,70, low-true reset inputs (R/) 72,74, which are inactive and electrically connected to the power supply voltage 178, and outputs 76,78, respectively. The pulse width of the signals 80,82 at the multivibrator outputs 76,78 is determined by the combination of resistors 84,86 and capacitors 88,90, respectively. This multivibrator RC time constant, which is provided by the resistor-capacitor combinations 84–88 and 86–90, controls the corresponding one-shot output pulse width, which has a predetermined value. In this manner, the code following apparatus 30 has an upper frequency response to the pulsating rail current 31 as a function of that predetermined pulse width value. For example, in the exemplary embodiment, and unlike known electro-mechanical relays, the upper frequency response is set at about 40 Hz, in order to avoid toggling the downstream flip-flop 64 in response to stray induced sources of noise, such as 50/60 Hz power supply noise. In this manner, the code following apparatus 30 mimics a corresponding upper frequency response of an electro-mechanical railway code following track relay (e.g., TR 2 of FIG. 1). The pulse width of the multivibrators 60,62 is preferably chosen to limit the upper frequency response of the circuit 46.

The first input (A) 64 of the first multivibrator 60, which input is sensitive to the leading edges of positive going pulses of signal 54, is electrically connected to the output 44 of the first Hall effect digital current sensor 38. The second input (B) 68 of the first multivibrator 60 is inactive and is electrically connected to the power supply voltage 178. The second input (B) 70 of the second multivibrator 62, which input is sensitive to the leading edges of negative going pulses of signal 55, is electrically connected to the output 45 of the second Hall effect digital current sensor 40. The first input (A) 66 of the second multivibrator 62 is inactive and is electrically connected to the power supply ground 176. In this manner, the output 76 of the first multivibrator 60 responds to the positive going edges from the first Hall effect digital current sensor 38, while the output 78 of the second multivibrator 62 responds to the negative going edges from the second Hall effect digital current sensor 40.

The flip-flop 64 includes a set input (S) 92, a reset input (R) 94 and an output (Q) 96. The first multivibrator output 76 is electrically interconnected with the flip-flop reset input 94. The second multivibrator output 78 is electrically interconnected with the flip-flop set input 92. In this manner, the flip-flop output 96 has the alternating signal 50 with a set state and a reset state in response to the pulsating rail current 31. In accordance with the present invention, under normal conditions, the alternating signal 50 indicates that the first and second Hall effect digital current sensors 38,40 are functional. Otherwise, the flip-flop output signal 50 is static with one of a set state and a reset state. This static signal indicates that one or both of the first and second Hall effect digital current sensors 38,40 is not functional. The alternating (i.e., ON and OFF) flip-flop output signal 50 proves that each of the Hall effect digital current sensors 38,40 is functional. Hence, if either sensor fails to respond to the pulsating rail current 31, then coding action of the flip-flop output 96 ceases a safe (dynamic) state.

The exemplary code following apparatus 30 is employed in combination with one or both of the first and second output circuits 98,100, in order to provide a solid state railway code following track relay 102, which turns ON and OFF in response to the pulsating rail current 31 from a code transmitter, such as TR 2 of FIG. 1. The circuits 98 and 100 include circuits 102 and 104 to output a first or FRONTS signal 106 and a second or BACKS signal 108, respectively. As discussed below in connection with FIG. 4, the second or BACKS signal 108 is a substantially inverted version of the first or FRONTS signal 106. The circuits 102,104 include field-effect transistors (FETs) 110,112 and circuits 116,118 to ensure that at least one of such FETs is turned off, in order to provide a break-before-make function.

When the common current 31 to the Hall effect digital current sensors 38,40 is interrupted, the sensor outputs 44,45 transition to the OFF state (e.g., high). This provides the positive going signal or pulse 80 on the first multivibrator output 76, which resets the flip-flop output 96. Correspondingly, the signal (SF) 120 switches to high and the FET 112 driving the BACKS signal 108 switches ON along with the corresponding downstream solid state relay 122 (as discussed below in connection with FIG. 5). Otherwise, when the flip-flop output 96 is set in response to a suitable level of the common current 31, the signal (SE) 124 switches to high and the FET 110 driving the FRONTS signal 106 switches ON along with the corresponding solid state relay 126 (shown in FIG. 5).

An inverter 128 suitably buffers and inverts the flip-flop output 96 to provide a buffered signal (SA) 130 to both of the circuits 98 and 100. The circuit 116 includes the series combination of three inverters 132,134,136. A delay circuit 138, which includes diode 140, parallel resistor 142 and capacitor 144, is disposed between the inverters 132,134 and suitably delays the high to low transition of the signal (SD) 146 (as best shown in FIG. 4) as output by inverter 134. This suitably delays the low to high transition of the signal (SE) 124 (as best shown in FIG. 4) as output by inverter 136.

The circuit 118 includes the series combination of a delay circuit 148 and two inverters 150,152. The delay circuit 148 includes diode 154, parallel resistor 156 and capacitor 158, is disposed between the inverters 128,150, and suitably delays the high to low transition of the signal (SC) 160 (as best shown in FIG. 4) as output by inverter 150. This suitably delays the low to high transition of the signal (SF) 120 (as best shown in FIG. 4) as output by inverter 152.

Figure 3:
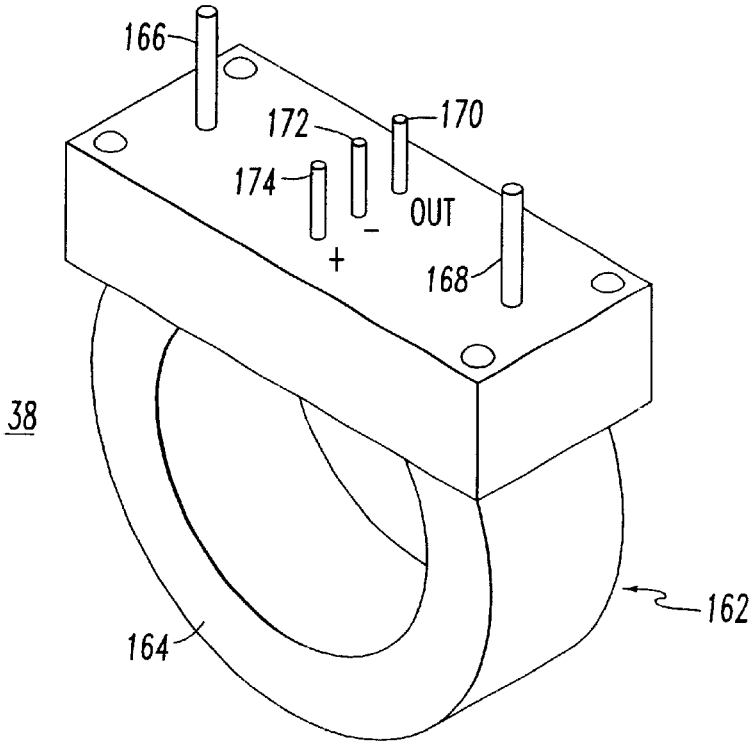
FIG. 3 is an isometric view of one of the Hall effect digital current sensors of FIG. 2.

FIG. 3 shows the package 162 for the exemplary Hall effect digital current sensor 38, it being understood that the sensor 40 has a similar package. A plastic shell filled with epoxy fixes a Hall sensor (not shown) in the air gap (not shown) of a ferrite core toroid 164. The five leads or pins 166,168,170,172,174 protrude from the bottom of the package 162 and enable printed circuit board mounting thereof. The pulsating rail current 31 to be sensed is applied to the sensor coil pins 166 ("+") and 168 ("−"). The pin 170 ("·") corresponds to the voltage output 44 of FIG. 2. The remaining two pins 172 and 174 are for the common or ground 176 and the supply voltage 178 (e.g., +5 VDC), respectively, of FIG. 2.

The Hall effect digital current sensors 38,40 of FIG. 2 include an output stage, which functions like a transistor. The sensor outputs 44,45 switch ON when magnetic flux in the air gap (not shown) of the toroids, such as 164, reaches a predetermined threshold and switch OFF at a somewhat lower threshold. The number of turns on the toroid 164 is adjusted in order that the "operate current" level suitably matches that of a conventional code following track relay.

FIG. 4 shows the timing of the apparatus 30 and circuits 116,118 of FIG. 2. The relationship between the pulsating rail current 31 and the signals 54,55 output by the respective Hall effect digital current sensors 38,40 is illustrated. The pulse width of the multivibrator output signals 82,80 is preferably selected in order to limit the upper limit of frequency to which the apparatus 30 responds and, thereby, enhances safety. This limit is less than the upper limit of conventional electro-mechanical track relays (e.g., TR 2 of FIG. 1) and, also, avoids toggling action from stray induced sources such as, for example, 50/60 Hz noise. The multivibrator output signals 82 and 80 are, in turn, employed to set and reset, respectively, (i.e., toggle) the subsequent flip-flop output 96 as shown by signal 50. Thereafter, the inverter 128 and circuits 116,118 provide the signals (SA–SF) 130,180, 160,146,124,120, in order to toggle the gates of the two FETs 110,112. In accordance with a preferred practice, as shown by the gate signals (SE,SF) 124,120 for the respective FETs 110,112 of FIG. 2, the circuits 116,118 delay the leading edges of the signals (SE,SF) 124,120, in order that these two FETs are never ON simultaneously. In turn, the two FETs are employed to activate the solid state relays 122,126 of FIG. 5, which mimic the function of electro-mechanical relay contacts.

Figure 5:
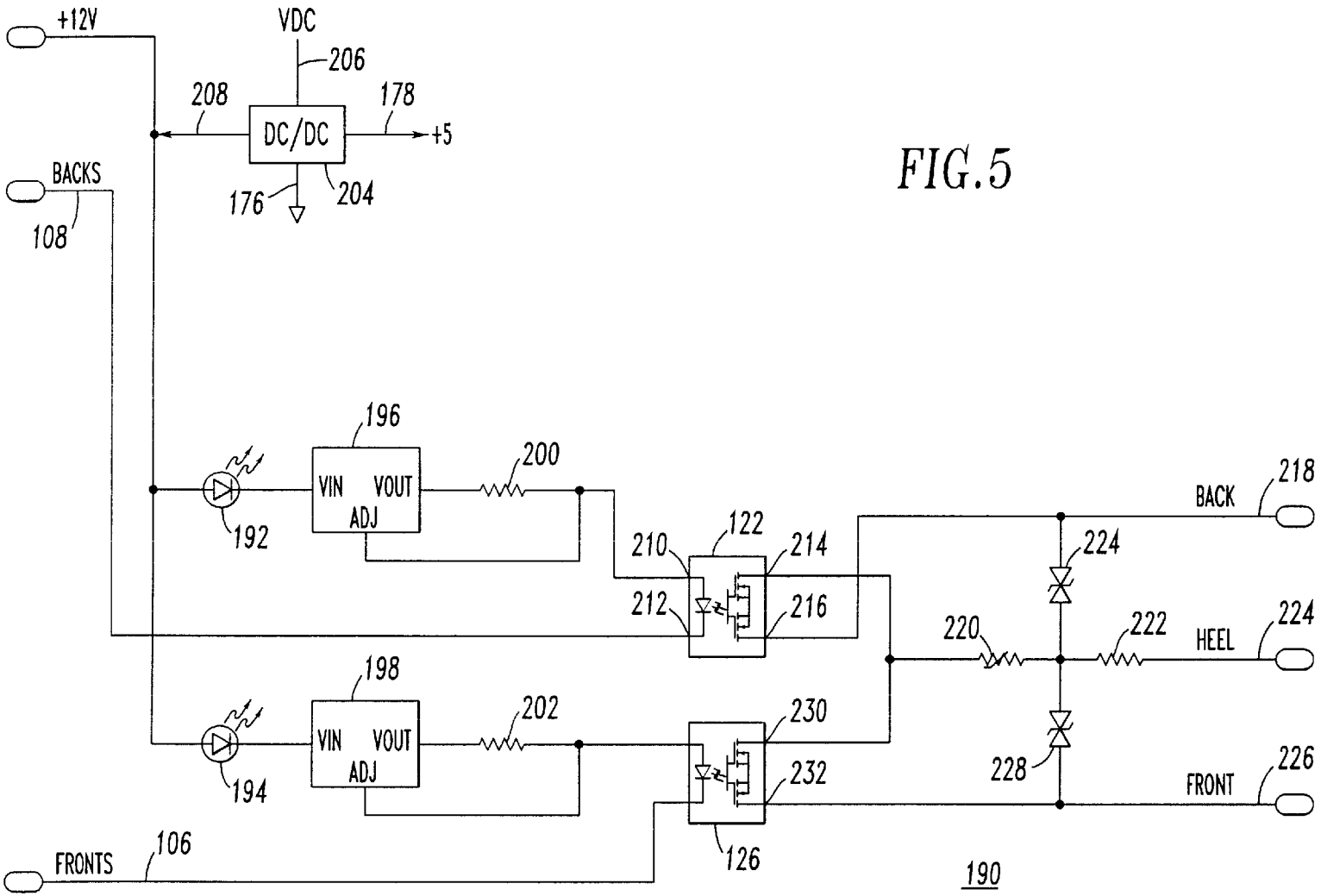
FIG. 5 is a block diagram in schematic form of downstream circuitry, which is driven by the solid state railway code following track relay of FIG. 2 in accordance with an embodiment of the invention.

FIG. 5 shows downstream circuitry 190, which is driven by the solid state railway code following track relay 102 of FIG. 2. Preferably, the FRONTS and BACKS signals 106, 108 from the corresponding front and back FETs 110,112 drive front and back electronic switching devices (e.g., solid state relays 126,122, respectively), which function like the mechanical contacts of an electro-mechanical relay. The circuitry 190 includes the solid state relays 122,126, LEDs 192,194, suitable constant current devices 196,198 (e.g., LM 317 made by National Semiconductor), and resistors 200, 202. A suitable DC/DC power supply 204 has a DC input 206 and provides the common or ground 176 of FIG. 2, the voltage 178 and the voltage 208 (e.g., +12 VDC). For example, the input 206 and voltage 208 may be provided by a battery.

Whenever the BACKS signal 108 is active (i.e., low), a suitable constant current is provided from the supply voltage 208, through the series combination of the LED 192, the constant current device 196 and the resistor 200, to the first input 210 of the solid state relay 122. In turn, the constant current flows from the second input 212 of the solid state relay 122 to the BACKS signal 108 and to the FET 112 of FIG. 2. In response, the LED 192 illuminates to indicate the active state of the BACKS signal 108 and the solid state relay 122 is energized to provide a suitably low impedance between the output terminals 214,216. The output terminal 216 is electrically connected to a BACK terminal 218, and the output terminal 214 is electrically connected through the series combination of a polyswitch 220 and a resistor 222 (e.g., having a suitably low resistance, such as 0.25 Ω) to a HEEL terminal 224. A suitable protection device, such as MOV or transorb 224, protects the solid state relay outputs 214,216 from an overvoltage condition. The series combination of the polyswitch 220 and the resistor 222 protects the solid state relay outputs 214,216 and the downstream circuitry (not shown) electrically connected to the output terminals 218,224 from an overcurrent condition.

A FRONT terminal 226 corresponds to the FRONTS signal 106. A suitable protection device, such as MOV or transorb 228, protects the second solid state relay outputs 230,232 from an overvoltage condition. The LED 194, the constant current device 198, the resistor 202, and the solid state relay 126 function in a similar manner as the respective LED 192, constant current device 196, resistor 200, and solid state relay 122, in order to illuminate the LED 194 and provide a suitably low impedance between the output terminals 230,232 in response to the active state (i.e., low) of the FRONTS signal 106. Otherwise, for the inactive state (i.e., high) of the FRONTS and BACKS signals 106,108, there is a suitably high impedance between the output terminals 226–224 and 218–224, respectively. As discussed above in connection with FIG. 2, the apparatus 30 and circuits 116,118 ensure that at least one of the FETs 110,112 is turned off (as best shown by the signals 120,124 of FIG. 4) and, hence, at most only one of the solid state relays 122,126 is energized at one time. By activating only one of the solid state relays 122,126, such that the other solid state relay is not simultaneously ON, duplicates the normally encountered break-before-make action of mechanical contacts.

In the ON state, the output resistance of the solid state relays 122,126 is about 0.05 Ω. Otherwise, in the OFF state, such resistance is several MΩ. A suitably high impedance is also provided between the output terminals 226–224 and 218–224 in response to loss of one or both of the voltages 178,208, and/or in response to an open circuit condition of the polyswitch 220. Preferably, the solid state relay outputs (such as 214,216) are electrically isolated from the corresponding solid state relay inputs (such as 210,212), thereby providing a mechanism to switch any downstream circuit (not shown) regardless of its voltage reference.

Figure 6:
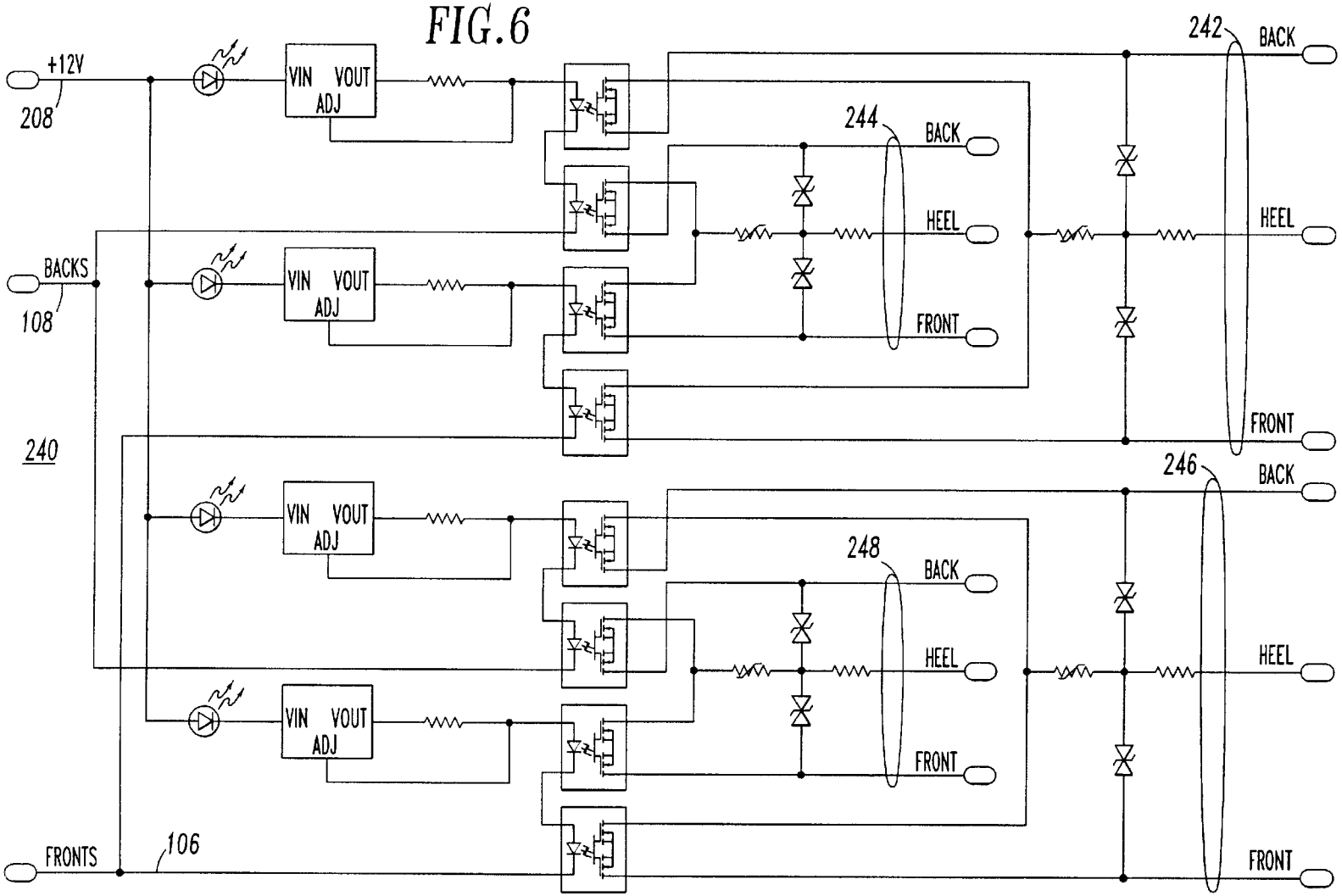
FIG. 6 is a block diagram in schematic form of downstream circuitry, which is driven by the solid state railway code following track relay of FIG. 2 in accordance with another embodiment of the invention.

FIG. 6 shows downstream circuitry 240, which is driven by the solid state railway code following track relay 102 of FIG. 2. The circuitry 240 is similar in operation to the circuitry 190 of FIG. 5, except that four independent sets 242,244,246,248 of FRONT, BACK and HEEL terminals are provided.

The exemplary solid state railway code following track relay 102 serves a similar useful function as a railway track code following electro-mechanical relay, while providing greater life and substantially reduced maintenance. The present invention also solves the problem of mechanical wear by replacing relay contacts with electronic switches.

The issue of possible significant increased operating sensitivity is addressed by deployment of redundant Hall effect digital current sensors 38,40 and the digital circuit 46, which ensures that both sensors 38,40 are operational. This digital circuit 46, which follows the two sensors 38,40, proves that each of such sensors is functional. For example, if either such sensor fails to respond to the pulsating rail current 31, then the coding action of the flip-flop output 96 ceases a safe state (i.e., transitions from dynamic to static).

However, periodic inspections of the Hall effect digital current sensors 38,40 are recommended. This guards against both sensors 38,40 becoming dramatically more sensitive. Sensitivity increases of both sensors in the range of double or triple is about the threshold where broken rail detection might be compromised.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A code following apparatus for receiving pulsating rail current from a railway code transmitter, said apparatus comprising:

first and second inputs structured to receive said pulsating rail current;

two Hall effect digital current sensors, each of said Hall effect digital current sensors having a coil and an output, which responds to current flowing through said coil, the coils of said Hall effect digital current sensors being electrically connected in series between said first and second inputs and being structured to receive said pulsating rail current, the outputs of said Hall effect digital current sensors being structured to turn on and off in response to said pulsating rail current;

means for determining that each of said Hall effect digital current sensors is functional; and at least one output structured to follow said pulsating rail current.

2. The apparatus as recited in claim 1 wherein said first and second inputs include first and second terminals and a resistor electrically interconnected with one of said first and second terminals, said resistor being in series with the coils of said Hall effect digital current sensors.

3. The apparatus as recited in claim 1 wherein the outputs of said Hall effect digital current sensors have a first state when said pulsating rail current is greater than a first current level and a second state when said pulsating rail current is less than a second current level.

4. The apparatus as recited in claim 3 wherein the first current level of a first one of said Hall effect digital current sensors is substantially identical to the first current level of a second one of said Hall effect digital current sensors.

5. The apparatus as recited in claim 4 wherein the outputs of said Hall effect digital current sensors turn on and off contemporaneously.

6. The apparatus as recited in claim 1 wherein the output of each of said Hall effect digital current sensors is an open-collector output having a signal with a plurality of positive going edges and a plurality of negative going edges in response to said pulsating rail current.

7. The apparatus as recited in claim 1 wherein the output of said Hall effect digital current sensors has a signal with a plurality of positive going edges and a plurality of negative going edges in response to said pulsating rail current; and wherein said means for determining comprises first and second one-shot multivibrators, said one-shot multivibrators having an input, which is connected to a corresponding one of the outputs of said first and second Hall effect digital current sensors, said one-shot multivibrators further having an output, the output of said first one-shot multivibrator responding to the positive going edges of the first Hall effect digital current sensor, and the output of said second one-shot multivibrator responding to the negative going edges of the second Hall effect digital current sensor.

8. The apparatus as recited in claim 7 wherein the output of each said first and second one-shot multivibrators has a predetermined pulse width; and wherein said apparatus has an upper frequency response to said pulsating rail current as a function of said predetermined pulse width.

9. The apparatus as recited in claim 8 wherein said upper frequency response mimics a corresponding upper frequency response of an electro-mechanical railway code following track relay.

10. The apparatus as recited in claim 8 wherein said upper frequency response is about 40 Hz.

11. The apparatus as recited in claim 7 wherein said means for determining further comprises a flip-flop including a set input, a reset input and an output; and wherein the output of said first one-shot multivibrator is electrically interconnected with the reset input of said flip-flop, and the output of said second one-shot multivibrator is electrically interconnected with the set input of said flip-flop.

12. The apparatus as recited in claim 11 wherein the output of said flip-flop has an alternating signal with a set state and a reset state, said alternating signal indicating that said first and second Hall effect digital current sensors are functional.

13. The apparatus as recited in claim 11 wherein the output of said flip-flop has a static signal with one of a set state and a reset state, said static signal indicating that at least one of said first and second Hall effect digital current sensors is not functional.

14. The apparatus as recited in claim 1 wherein the coil and the output of each of said Hall effect digital current sensors are electrically isolated.

15. A solid state code following track relay for receiving pulsating rail current from a railway code transmitter, said track relay comprising:

first and second inputs structured to receive said pulsating rail current;

two Hall effect digital current sensors, each of said Hall effect digital current sensors having a coil and an output, which responds to current flowing through said coil, the coils of said Hall effect digital current sensors being electrically connected in series between said first and second inputs and being structured to receive said pulsating rail current, the outputs of said Hall effect digital current sensors being structured to turn on and off in response to said pulsating rail current;

means for determining that each of said Hall effect digital current sensors is functional; and at least one solid state output structured to follow said pulsating rail current.

16. The solid state code following track relay as recited in claim 15 wherein the output of said Hall effect digital current sensors has a signal with a plurality of positive going edges and a plurality of negative going edges in response to said pulsating rail current; wherein said means for determining comprises first and second one-shot multivibrators, said one-shot multivibrators having an input, which is connected to a corresponding one of the outputs of said first and second Hall effect digital current sensors, said one-shot multivibrators further having an output, the output of said first one-shot multivibrator responding to the positive going edges of the first Hall effect digital current sensor, and the output of said second one-shot multivibrator responding to the negative going edges of the second Hall effect digital current sensor; wherein said means for determining further comprises a flip-flop including a set input, a reset input and an output; and wherein the output of said first one-shot multivibrator is electrically interconnected with the reset input of said flip-flop, and the output of said second one-shot multivibrator is electrically interconnected with the set input of said flip-flop.

17. The solid state code following track relay as recited in claim 16 wherein said first and second output circuits comprise means for outputting a first signal and means for outputting a second signal, which is a substantially inverted version of said first signal, respectively.

18. The apparatus as recited in claim 17 wherein said first and second output circuits further comprise first and second FETs, respectively, and wherein said means for outputting a first signal and said means for outputting a second signal include means for ensuring that at least one of said first and second FETs is turned off.

19. The apparatus as recited in claim 18 wherein said at least one solid state output comprises first and second electronic switching devices; and wherein said first and second FETs drive said first and second electronic switching devices, respectively.

20. The apparatus as recited in claim 19 wherein said first and second electronic switching devices are first and second solid state relays, respectively.

21. A code following apparatus for a pulsating rail current from a railway code transmitter, said apparatus comprising:

a first terminal structured to input said pulsating rail current;

a second terminal structured to output said pulsating rail current;

first means for responding to said pulsating rail current flowing from said first terminal and for outputting a corresponding first signal, which turns on and off in response to said pulsating rail current;

second means for responding to said pulsating rail current flowing from said first means and toward said second terminal and for outputting a corresponding second signal, which turns on and off in response to said pulsating rail current;

means for determining that each of said first and second means is functional based upon said first and second signals and for outputting a third signal, which follows said pulsating rail current; and at least one output structured to follow said third signal.

* * * * *

UNITED STATES PATENT AND TRADEMARK OFFICE

CERTIFICATE OF CORRECTION

PATENT NO. : 6,494,409 B1
DATED : December 17, 2002
INVENTOR(S) : Raymond C. Franke It is certified that error appears in the above-identified patent and that said Letters Patent is hereby corrected as shown below:

Title page,
Item [56], OTHER PUBLICATIONS, first reference, “200,” should read -- 2000, --.

Column 1,
Line 17, “the-resistor,” should read -- the resistor, --.

Signed and Sealed this

Twenty-fourth Day of June, 2003

JAMES E. ROGAN
*Director of the United States Patent and Trademark Office*